United States Patent [19]

Taira et al.

[11] Patent Number: 4,735,835

[45] Date of Patent: Apr. 5, 1988

[54] SEAM COVERED WELDED CAN

[75] Inventors: Kazuo Taira, Tokyo; Sachiko Ishikawa, Yokohama; Hisakazu Yasumuro, Yokohama; Kenji Matsuno, Yokohama; Hiroshi Matsubayashi, Kamakura, all of Japan

[73] Assignee: Toyo Seikan Kaisha, Ltd., Tokyo, Japan

[21] Appl. No.: 901,648

[22] Filed: Sep. 2, 1986

[30] Foreign Application Priority Data

Aug. 31, 1985 [JP] Japan ..... 60-190919

[51] Int. Cl.[4] ..... B65D 23/02

[52] U.S. Cl. ..... 428/35; 428/458; 220/75; 220/456; 220/458; 426/131

[58] Field of Search ..... 220/75, 456, 457, 458; 426/126, 131; 428/35, 458

[56] References Cited

U.S. PATENT DOCUMENTS

| | | | |
|---|---|---|---|
| 4,339,483 | 7/1982 | Ueno et al. | 426/131 |
| 4,382,525 | 5/1983 | Kobayashi et al. | 220/456 |
| 4,387,830 | 6/1983 | Kitamura et al. | 220/456 |
| 4,477,501 | 10/1984 | Kojima et al. | 220/457 |

*Primary Examiner*—John E. Kittle
*Assistant Examiner*—James J. Seidleck
*Attorney, Agent, or Firm*—Sherman and Shalloway

[57] ABSTRACT

Disclosed is a welded can having at least the inner face side of a weld seam covered with a composite film of a thermoplastic resin, wherein the thermoplastic resin composite film comprises (I) an innermost layer, located on the inner face side of the can, of a thermoplastic polyester having a molecularly oriented crystal and comprising a dibasic acid component content of at least 90 mole % of terephthalic acid and a diol component containing at least 90 mole % of ethylene glycol, said innermost layer (I) overlayer (II) a seam-contacting layer, located on the seam side, of a thermoplastic copolyester containing in the chain molecule a dibasic acid component containing 40 to 95 mole % of terephthalic acid and 0 to 40 mole % of isophthalic acid and a diol component containing ethylene glycol and butane diol in a total amount of 65 to 100 mole % at a molar ratio of from 5/95 and 80/20 or a blend of such copolyesters, and the composite film comprising the layers (I) and (II) has an elasticity modulus of 5 to 220 kg/mm$^2$ at a temperature lower by 20° C. than the softening temperature of the resin of the layer (II).

17 Claims, 1 Drawing Sheet

SEAM COVERED WELDED CAN

BACKGROUND OF THE INVENTION (1) Field of the Invention

The present invention relates to a seam covered welded can. More particularly, the present invention relates to a seam covered welded can having a covering layer excellent in the corrosion resistance, adhesion and processability on a welded seam, especially a seamed covered welded can having a composite covering layer comprising a specific polyester and a specific copolyester.

(2) Description of the Prior Art

As the process for the production of a can body, there has been widely adopted a process comprising forming a cylindrical body from a metal can blank cut in a predetermined size, lapping both the ends of the blank and bonding the lapped portion by welding or using an adhesive or solder.

In a can body obtained according to this process, a cut end portion of the blank, that is, a cut edge, is inevitably present on the inner face side of the side seam, and in order to prevent corrosion of the blank and dissolution of the metal into a content, it is very important to cover this cut edge of the blank. Especially in case of a welded seam, in addition to the above-mentioned cut edge, the molten metal is exposed on the entire seam, a portion (splash portion) to which the metal protrudes is formed and there also is present a step portion of the seam. Therefore, it is very difficult to make the covering resin layer on the entire surface of the seam.

Various proposals have been made on the process for protecting the seam by forming a covering resin layer on the welded seam. For example, there is known a process in which a solution or powder paint is coated on the inner face side of the seam of a formed can body, or a process in which a thermoplastic resin tape is supplied to the inner face side of the seam and fusion-bonded. Furthermore, there is known a process in which a paint comprising a thermosetting resin and a thermoplastic resin at a certain ratio is applied to the inner face side of a seam to form a protecting coating having a specific dispersion state. However, a paint excellent in the adhesion to the seam tends to be poor in the barrier property to corrosive components while a paint excellent in the barrier property to corrosive components is generally poor in the adhesion. In general, a welded can after covering of the seam is subjected to processing such as necked-in processing, beading, flanging and double seaming and then to retort sterilization at a high temperature exceeding 120° C. Accordingly, if a welded can is poor in any one of adhesion, processability, heat resistance and corrosion resistance, there arises a problem of the dissolution of the metal or the leakage by pitting.

Moreover, in the case where a resin as mentioned above is used, the paint or coating of the resin flows in the molten state so that it fills a stepped portion present in the seam, and therefore, the coating is cut or thinned at an angular part of the cut edge or bubbles are easily contained in the coating at the stepped portion. Accordingly, it is almost impossible to form a complete covering at the cut edge of the blank.

SUMMARY OF THE INVENTION

We found that if a coating having a laminate structure comprising an upper layer composed of a thermoplastic polyester having a molecularly oriented crystal and a lower layer composed of a thermoplastic copolyester havng a specific composition and specific viscoelastic properties is used for covering a welded seam, there can be obtained a seam covered welded can excellent in the combination of adhesion, processability, heat resistance and corrosion resistance.

It is therefore a primary object of the present invention to provide a seam covered welded can excellent in the combination of adhesion, processability, heat resistance and corrosion resistance of the covering layer.

Another object of the present invention is to provide a seam covered welded can in which dissolution of the metal through the welded seam or pitting is prevented even after severe can-manufacturing processing or heat sterilization of a content.

Still another object of the present invention is to provide a welded seam can in which complete covering is accomplished only by a heat fusion operation without evaporation of the solvent or baking of the coating.

More specifically, in accordance with the present invention, there is provided a welded can having at least the inner face side of a weld seam covered with a layer of a thermoplastic resin, wherein the thermoplastic resin layer comprises (I) a layer, located on the inner face side of the can, of a thermoplastic polyester having a molecularly oriented crystal and comprising a dibasic acid component of at least 90 mole% of terephthalic acid and a diol component containing at least 90 mole% of ethylene glycol and (II) a layer, located on the seam side, of a thermoplastic copolyester containing in the chain molecule a dibasic acid component containing 40 to 95 mole% of terephthalic acid and 0 to 40 mole% of isophthalic acid and a diol component containing ethylene glycol and butane diol in a total amount of 65 to 100 mole% at a molar ratio of from 5/95 and 80/20 or a blend of such copolyesters, and a composite film comprising the layers (I) and (II) has an elasticity modulus of 5 to 220 kg/mm$^2$ at a temperature lower by 20° C. than the softening temperature of the resin of the layer (II).

In view of the continuity and completeness of the covering layer, it is preferred that the thermoplastic polyester layer (I) having a molecular oriented crystal and the thermoplastic copolyester or copolyester blend layer (II) be applied to in the form of a laminate film to the weld seam on the inner face side of the can and be heat-bonded in the state that the polyester layer (I) has a molecular orientation.

DETAILED DESCRIPTION OF THE INVENTION

Structure of Seam Covered Can

Figure 1:
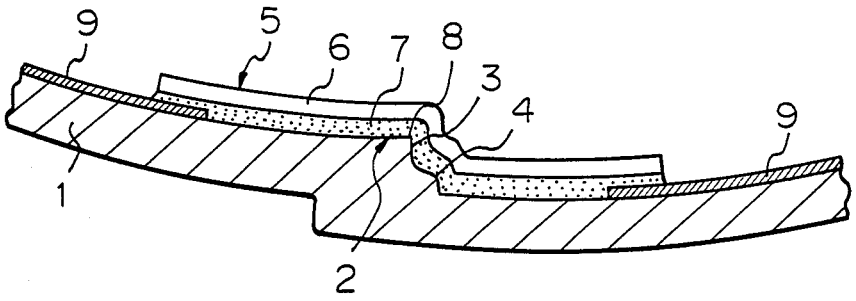
FIG. 1 is a diagram illustrating a main part of the seam covered welded can according to the present invention.

Referring to FIG. 1 illustrating a main part of the seam covered welded can of the present invention (the inner face side of the can is shown as the upper side and the outer face side is shown as the lower side), a metal blank 1 for a can, which is cut in a predetermined size, is formed into a cylindrical shape, and end edges are lapped and welded to form a seam 2. A protecting resin coating 9 may be applied to the inner face of this can body except the seam 2 or the portion close thereto.

On the seam 2 located on the inner face side of the can body, there is present a cut edge 3 of the blank or a protrusion 4 of the metal blank formed by welding. A resin layer 5 covers this cut edge or protrusion.

The most important characteristic of the present invention is that this covering resin layer 5 consists of a layer 6 of a thermoplastic polyester having a molecularly oriented crystal, described in detail hereinafter, and a layer 7 of a thermoplastic copolyester having a specific composition and specific viscoelastic characteristics or a blend of such copolyesters. As is apparent from the drawings, the polyester layer 6 is present on the inner face side of the can and the copolyester layer 7 is located on the seam side.

Characteristics and Functions of Welded Can

One prominent characteristic of the seam covered welded can of the present invention is that the upper thermoplastic polyester layer 6 has a molecularly oriented crystal even after fusion bonding. The molecularly oriented crystal is an idea contrasted to a thermal crystal in one aspect and to an amorphous structure in another aspect. Namely, crystallization by orientation of the polyester molecule chain is meant. The present invention is based on the finding that for the heat resistance of the seam covering, especially the resistance against hot water, corrosion resistance and resistance against the processing operation, it is important to impart a molecular orientation to the topmost surface of the seam covering. It is known that the gas barrier property depends greatly on the crystallization degree. According to the present invention, by introducing a molecularly oriented crystal to the topmost surface of the resin layer, the barrier property to corrosive components is improved, and as shown in examples given hereinafter, the corrosion resistance is prominently improved. It also is important that the polyester layer should not have a thermal crystal but an oriented crystal. For example, in the case where the polyester is thermally crystallized, the resin layer is brittle and is readily cracked or broken at the processing step and is ragged by retort sterilization, resulting in degradation of the hot water resistance. Furthermore, if the polyester layer is amorphous, whitening (thermal crystallization) is caused and deterioration cannot be avoided. According to the present invention, since the polyester has a molecularly oriented crystal, this whitening is prevented.

In the present invention, it is the copolyester layer 7 that makes a contribution to the adhesion to the seam. By adoption of the above-mentioned composition, a good and durable adhesion or bonding to not only the metal substrate of the seam but also the oriented polyester layer 6 can be obtained. Furthermore, this copolyester layer 7 flows even to the cut edge 3 or the stepped portion of the protrusion 4 in the molten state and wets the cut edge 3 or the protrusion sufficiently to obtain a complete adhesion.

In order to manifest the above-mentioned functional effects and also to fill the resin in the stepped portion with no crevice while preventing cutting or thinning of the covering at an angular part 8 of the cut edge, it is important that the oriented polyester layer 6 and the copolyester layer 7 should be used in the state of a laminate for covering the seam.

In this connection, in order to manifest the above-mentioned functional effects in the present invention, it is important that a laminate film comprising the layers (I) and (II) should have an elastic modulus of 5 to 220 kg/mm$^2$, especially 15 to 200 kg/mm$^2$, at a temperature lower by 20° C. than the softening point of the resin layer (II). More specifically, if the elastic modulus at a temperature close to the softening point is too high and exceeds the above-mentioned range, it is difficult to fit the composite film precisely to a fine stepped portion formed by welding when the composite is pressed thereto, and air is left between the metal blank and the covering layer and complete adhesion is impossible, with the result that corrosion is advanced from this portion. If the elastic modulus at a temperature close to the softening point is too low and below the above-mentioned range, the composite film is cut or thinned at the angular part of the cut edge when the composite is pressed, and complete covering is often difficult.

According to the present invention, by using the composite film comprising the layers 6 and 7, there can be provided a seam covered welded can excellent in the combination of adhesion, processability, heat resistance and corrosion resistance of the covering.

Respective Materials

(1) Molecularly Oriented Crystalline Polyester

It is important that the polyester should be a polyester comprising a dibasic acid component comprising at least 90 mole% of terephthalic acid and a diol component comprising at least 90 mole% of ethylene glycol, and it is most preferred that the polyester be polyethylene terephthalate. In a polyester in which the terephthalic acid or ethylene glycol content is lower than 90 mole%, the softening temperature is low and the heat resistance is degraded. Furthermore, the bonding temperature of the copolyester layer becomes close to the melting point of the polyester, and it becomes difficult to effect bonding in the state where the molecularly oriented crystal is left. In a polyester comprising ethylene terephthalate units, the molecularly oriented crystal is caused more easily than in other polyesters, and in the present invention, by using this polyester, high heat resistance and corrosion resistance can be imparted.

The presence of the molecularly oriented crystal can be confirmed by the method of measuring the crystallization degree, for example, the density method or X-ray diffractometry, the method of measuring the orientation degree, for example, the birefringence method or polarized fluorescence method, or the method of observing the appearance. For example, it can be said that if the density (30° C.) measured by a density gradient tube is 1.35 to 1.43 g/cc, especially 1.37 to 1.41 g/cc, and the resin layer is substantially transparent, the resin layer has a molecularly oriented crystal intended in the present invention. Furthermore, by the birefringence method or polarized fluorescene method, it can be judged whether or not the biaxial molecular orientation (in-plane orientation) is effectively left in the polyester.

As the dibasic acid component that can be contained in a small amount in the recurring units of the polyester, there can be mentioned isophthalic acid, naphthalenedicarboxylic acid, phthalic acid, sebacic acid, adipic acid and azelaic acid. As the diol component that can be contained, there can be mentioned butane diol, diethylene glycol, triethylene glycol and 1,4-cyclohexane dimethanol.

It is sufficient if the molecular weight of the polyester is within a film-forming range. From this viewpoint, it is preferred that the intrinsic viscosity measured at 30° C. with respect to a solution in phenol/tetrachloroethane (6/4 weight ratio) having a concentration of 0.5 g/dl be at least 0.5 dl/g, especially 0.6 dl/g.

In order to hide the seam or effect color matching with the inner face coating, fine particles of an inorganic pigment such as titanium white, zinc oxide, alumina powder, calcium carbonate, barium sulfate, silica or talc or an organic pigment may be incorporated into the polyester layer at a known mixing ratio according to the intended object.

(2) Copolyester

The copolyester used in the present invention should be a copolyester comprising in the chain molecule a dibasic acid component comprising 40 to 95 mole%, especially 60 to 90 mole%, of terephthalic acid and 0 to 40 mole%, especially 0 to 35 mole%, of isophthalic acid and a diol component comprising ethylene glycol and butane diol in a total amount of 65 to 100 mole% at an ethylene glycol/butane diol molar ratio of from 5/95 to 80/20, especially from 10/90 to 75/25 or a blend of such copolyesters.

In order to bond this copolyester tightly to the oriented crystalline polyester, the terephthalic acid and ethylene glycol components should be contained in the chain molecule, and in order to bond the copolyester tightly to the metal of the seam, the isophthalic acid and butylene glycol components should be contained in the chain molecule.

If the terephthalic acid content is below the above-mentioned range, the heat resistance and hot water resistance of the covering are degraded, and formation of a resin of a high polymerization degree excellent in the processability becomes difficult. If the terephthalic acid content exceeds the above-mentioned range, selections of a glycol component giving an appropriate bonding temperature becomes difficult. If the isophthalic acid content exceeds 40 mole%, the softening point is lowered and the heat resistance and hot water resistance are degraded. Furthermore, the moisture sensitivity is increased and bubbling is readily caused at the bonding step, and the resin layer (II) protrudes extremely at the bonding step and seam leakage is readily caused.

In order to maintain the softening temperature of the copolyester within a range giving sufficient heat resistance and corrosion resistance without degrading the crystallization and orientation of the polyester layer (I), it is indispensable that the total content of ethylene glycol and butylene glycol should be at least 65 mole%. If the ratio of ethylene glycol is below the above-mentioned range, the adhesion to the polyester layer (I) is reduced and delamination is caused between the resin layers (I) and (II) at the processing or sterilization step or during the storage and the corrosion resistance is degraded. Furthermore, if the ratio of butylene glycol is below the above-mentioned range, the adhesion of the resin layer (II) to the metal substrate of the seam or the inner surface protecting coating is degraded and adhesion failure is caused at the processing or sterilization step or during the storage, resulting in reduction of the corrosion resistance. Moreover, thermal crystallization is readily advanced in the resin (II) at the sterilization step, and the resin (II) becomes brittle, adhesion failure or cracking is readily caused and the corrosion resistance is degraded.

In the copolyester used in the present invention, other dibasic acid component and/or other diol component may be contained in addition to the above-mentioned indispensable components within a range satisfying the above-mentioned requirements. As the dibasic acid component, there may be incorporated, for example, aromatic dicarboxylic acids such as phthalic acid and aliphatic or alicyclic dicarboxylic acids such as adipic acid and sebacic acid, and as the diol component, there may be incorporated diethylene glycol, triethylene glycol, propylene glycol, neopentyl glycol and xylylene glycol.

A blend of two or more of such copolyesters may also be used. It is sufficient if the contents of the respective components in the blend as a whole are within the above-mentioned ranges. The molecular weight of the copolyester may be within a film-forming range.

Other resin may be blended into the copolyester for improving the physical properties of the copolyester. As the thermoplastic resin suitable for blending, there can be mentioned an acid-modified olefin resin. As preferred examples of the acid-modified olefin resin, there can be mentioned an ethylene/acrylic acid copolymer, maleic anhydride-grafted polyethylene, maleic anhydride-grafted polypropylene and an ion-crosslinked olefin copolymer (ionomer), though acid-modified olefin resins that can be used in the present invention are not limited to those exemplified above. It is preferred that the acid-modified olefin resin be incorporated in an amount of 3 to 40% by weight, especially 10 to 30% by weight, based on the copolyester or copolyester blend. In this case, it is preferred that the copolyester or copolyester blend should form a continuous phase while the acid-modified olefin resin is present in the form of dispersed particles.

(3) Welded Can

As the metal blank constituting the can body, there can be mentioned an untreated steel plate (black plate), electrolytically plated and melt-plated steel plates such as a tinplate sheet, a zinc-plated steel plate and a chromium-plated steel plate, steel plates chemically treated with chromic acid or phosphoric acid, chemically formed steel plates such as an electrolytically chromate-treated steel plate, and a thinly nickel-plated steel plate and a steel plate plated with a small amount of tin. Furthermore, a plate of a light metal such as an aluminum plate can be used.

The side seam may be preferably formed by electric resistance welding. The electric resistance welding for formation of the side seam can be accomplished by forming a can blank into a cylinder and passing the formed lap portion through a pair of electrode rollers or passing the lap portion through a pair of upper and lower electrode rollers via an electrode wire. In order to prevent formation of a porous metal oxide layer on the outer surface of the seam and improve the adhesion of the protecting coating film, it is preferred that the welding operation be carried out in an inert atmosphere and maintain this inert atmosphere until the surface temperature of the welded portion is lowered to 550° C. As the inert atmosphere, there can be used nitrogen, argon, neon, hydrogen and carbon dioxide. It is preferred that the operation be carried out while maintaining the weld portion in a current of the above-mentioned inert gas, but the operation may be carried out in a sealed vessel filled with an inert gas as mentioned above.

The width of the side seam of the welded can differs according to the diameter of the can, but a relatively small width such as 0.2 to 1.2 mm is sufficient. The above-mentioned seam-forming method is prominently advantageous in that the amount used of the can blank can be reduced. The thickness of the seam can be changed within a range of from 1.2 times to 2 times the thickness of the blank. This welding method is also advantageous in that the thickness of the seam is reduced by pressing the lap portion by a high pressing force at the welding step, whereby the difference in the level between the seamed portion and the other portion can be reduced at the double seaming step.

It is preferred that the metal blank, except the portion to be formed into the seam, is preferably coated with various inner surface protecting resin paints before the welding operation. All of the thermosetting resins heretofore used in the field of paints can be used as the protecting thermosetting resin. As preferred examples, there can be mentioned a phenol-formaldehyde resin, a furan-aldehyde resin, a xylene-formaldehyde resin, a ketone-formaldehyde resin, a urea-formaldehyde resin, a melamine-formaldehyde resin, an alkyd resin, an unsaturated polyester resin, an epoxy resin, a bismaleimide resin, a triallyl cyanurate resin, a thermosetting acrylic resin, a silicone resin and an oleo-resin. These resins may be used singly or in the form of mixtures of two or more of them. As the protecting thermoplastic resin paint, there can be mentioned vinyl type paints such as paints of a vinyl chloride-vinyl acetate copolymer, a saponification product thereof, a vinyl chloride-acrylic (methacrylic) acid copolymer, a vinyl chloride-maleic anhydride copolymer and a vinyl chloride-maleic anhydride-acrylic acid ester copolymer.

A paint preferred in view of the adhesion to the copolyester and the corrosion resistance is a mixture of an epoxy resin component with at leaat one resin selected from the group consisting of a phenolic resin, a urea resin, a melamine resin a vinyl resin and a thermosetting acrylic resin. The coating-forming resins may be used in the form of a mixture or precondensate for a paint.

It is preferred that the thickness of the inner surface protecting coating be 0.1 to 30 μm, especially 1 to 15 μm.

The inner surface protecting layer may be formed by multiple coating of one resin or different resins selected from the above-mentioned group. In this case, there may be adopted a method in which a metal plate (blank) coated and baked with a base coat is welded, the formed seam is covered with the above-mentioned composite film and a topcoat is sprayed and baked. The layer (I) of the polyester having a molecularly oriented crystal can exert the characteristics sufficiently at the baking temperature adopted in this case.

Formation of Covering

In the present invention, the composite film (laminate film) comprising the oriented crystalline polyester layer (I) and the copolyester layer (II) is first prepared. In this laminate film, it is preferred that the thickness of the layer (I) be 2 to 120 μm, especially 7 to 90 μm, and the thickness of the layer (II) be 5 to 120 μm, especially 10 to 100 μm. It also is preferred that the total thickness of the composite film be 10 to 150 μm, especially 15 to 100 μm. Of course, the entire thickness of the laminate film should be such that the above-mentioned elastic modulus at a temperature close to the softening point is satisfied.

Formation of the laminate film can be prepared according to any of the known methods. For example, a polyester film oriented and crystallized in advance by biaxially drawing is bonded to a preliminarily formed film of the copolyester or copolyester blend through a urethane type adhesive to form a laminate film. Furthermore, a copolyester or copolyester blend is extrusion-coated on the biaxially drawn polyester film to form a laminate film. In these methods, bonding should be carried out under the conditions where the oriented crystal is stably maintained. Furthermore, it must be understood that there can be adopted a method in which both the resin layers are preliminarily or weakly bonded to such an extent that substantial delamination is not caused and a strong bonding state is attained when the laminate film is covered on the seam.

As another example of the method for the preparation of a laminate film, there can be mentioned a method in which the polyester layer (I) and copolyester layer (II) are co-extruded from extrudes through a multi-layer multi-ply die to form a T-die film, the co-extruded film is heated at a drawing temperature higher than the glass transition temperature, for example, at 65° to 100° C. in case of a polyethylene terephthalate film and stretch-drawn in the longitudinal direction between rollers and simultaneously, the film is drawn in the lateral direction by a tenter. Then, the film is thermally set if necessary. By this biaxial drawing, molecular orientation crystallization is effected in the polyester layer (I), but in the copolyester layer (II), molecular orientation is not fixed or even if some molecular orientation is fixed, this molecular orientation is lost at the subsequent bonding to the seam.

It is indispensable that the laminate film should comprise at least the polyester layer (I) and the copolyester layer (II). The laminate film may further comprise other resin layer according to need for further improving the characteristics. For example, lamination of a resin layer composed mainly of polyvinylidene chloride on one surface of the polyester layer is effective for improving the covering property of the composite film on a welded can. For this purpose, a known method such as a coating or co-extrusion method may be added to the above-mentioned typical preparation method. In this case, however, it is indispensable that the physical properties of the composite film should be within the above-mentioned ranges, as illustrated in examples given hereinafter.

Any known method is applied to the heat bonding of the composite film so far as the molecularly oriented crystal of the polyester layer (I) is maintained. For example, the composite film is supplied to a welded can in such a positional relation that the copolyester (II) confronts the seam. After this registering, the composite film is pressed to the seam by an elastic body of a silicone rubber or the like and is heated by such heating means as high-frequency induction heating. The heating temperature and heating time are determined so that the oriented crystal of the polyester layer (I) is substantially maintained and the copolyester layer (II) is substantially completely molten and softened to attain complete adhesion to the metal substrate of the seam.

The width of the composite film used for covering the seam should be determined while taking the margin width of the inner surface protecting coating of the seam into consideration, and it is preferred that lapping of at least 0.3 mm be maintained between the composite film and the inner surface protecting coating on one side.

After completion of heat bonding, the seam and covering are cooled to fix the covering.

Uses

The seam covered can of the present invention can be used in various fields as a vacuum can which is retort-sterilized after filling of a content, an inner pressure can in which a carbonated drink is filled, an aerosol can and the like.

The present invention will now be described in detail with reference to the following examples.

Welded can bodies used in the examples were prepared according to the following process.

In case of a tinplate welded can, an epoxy-phenolic paint (a 1/1 mixture of an epoxy resin and a phenolic resin) was coated in a thickness of 5 microns after baking on a tinplate sheet having a thickness of 0.23 mm and a plated tin amount of 25 lb/B.B. (a tin layer thickness of about 0.6 μm) except a portion to be formed into a seam of a can body on the inner face side by margin coating, and the outer face side of the tinplate sheet was margin-printed with a printing ink. The coatings were baked and cured for 10 minutes in hot air drying furnace maintained at 200° C. and 175° C. respectively. The coated tinplate sheet was cut into a body blank of No. 7 can size (blank length=206.4 mm, blank height=104.5 mm). The blank was formed into a cylinder by a roll former so that the short side was in the axial direction. In a welding station, cut edges were lapped and fixed, and by using a commercially available seam welding machine comprising two roll electrodes connected through a wire electrode, a pressing force (40 kg/mm$^2$) was applied to the lap portion of the formed body, and in a nitrogen current, a welded can body (No. 7 can size having a nominal diameter of 211 and an inner volume of 318.2 ml) was prepared at a can-manufacturing speed of 30 m/min. This tinplate welded can was used in Examples 2 and 5.

In case of a TFS welded can, an epoxy-phenolic paint (an 80/20 mixture of an epoxy paint and a phenolic resin) was coated on the inner face side of a tin-free steel (TFS) plate having a thickness of 0.23 mm except a portion to be welded and a surrounding portion by so-called margin coating so that the coating thickness after baking was 7 μm, and the outer face side was margin-coated with a printing ink. After the predetermined baking treatment, the coated TFS plate was cut into a body blank of No. 7 can size (blank length=206.4 mm, blank height=104.5 mm). The blank was formed into a cylinder by a roll former so that the short side is in the axial direction. In a welding station, cut edges were lapped and fixed, and seam welding was carried out in a nitrogen current by using a welding machine comprising two electrodes connected through a wire electrode. The obtained welded TFS can was used in Examples 1, 3 and 6.

In the same manner as described above in case of TFS, a welded can body for No. 2 can size was prepared from a thinly nickel-plated steel plate having a thickness of 0.24 mm (the amount plated of nickel was 500 mg/m$^2$ and the amount of chloromium was 13 g/m$^2$), and this can body was used in Example 4.

(Evaluation of Properties of Films)

The physical properties of composite films used for covering seams of welded can bodies were evaluated according to the following methods.

Incidentally, the properties 1 through 3 mentioned below could be measured with respect to a composite film before covering of a welded can. However, in order to directly know the properties of the can, the composite film was sampled from the covered can by removing the metal substrate and the physical properties of the sampled composite film were measured. The physical properties of the film were somewhat changed by the thermal history of the covering processes, but this change was much smaller than the change caused by the change of the composition or the like and was slightly larger than the measurement precision.

1. Presence or Absence of Molecularly Oriented Crystal in Polyester Layer (I)

The X-ray diffractometry, the polarized fluorometry, the birefringence method and the infrared spectrometry are generally used for confirmation of the presence or absence of the molecularly oriented crystal. However, as simple means, the observation of the whitening degree of the layer (I) and the surface gloss and the measurement of the density by a density gradient tube were adopted. In each example, the presence or absence of the molecularly oriented crystal and the density measured at 30° C. were shown.

2. Softening Temperature of Copolyester Layer (II)

According to the thermal mechanical analysis (TMA) method, a penetration curve was obtaiend at a temperature-elevating rate of 20° C./min by using a thermal mechanical analysis apparatus supplied by Rigaku Denki, and the softening point was obtained from the curve according to customary procedures.

3. Elastic Modulus of Composite Film

With respect to a composite film piece having a width of 3 mm and a length of 20 mm, the temperature dependency of the dynamic elastic modulus (E') was measured at a frequency of 110 Hz and a temperature-elevating rate of 2° C./min by using a dynamic viscoelasticity measuring apparatus (Rheovibron Model DDV-II-EA), and the value of E' at a temperature lower by 20° C. than the softening temperature determined in 2 above was read.

In the case where the copolyester layer (II) contained an acid-modified olefin resin and had a heterogeneous structure, a sectional slice (having a thickness of about 10 to about 20 μm) was cut out from the film by a microtome and the dispersion state was observed by an optical microscope.

(Evaluation of Processability of Film Covered Portion of Welded Can Seam)

A predetermined composite film was covered on the seam and beading, flanging and double seaming of one lid were carried out, and a test piece having a width of 4 cm and a height of about 10 cm was cut out in the height direction from the seam-surrounding portion of the obtained one end seam can. Then, the test piece was subjected to the following tests.

1. Copper Sulfate Test

The test piece was immersed for 5 minutes in an aqueous solution containing 20% of copper sulfate (containing about 5% of hydrochloric acid) at 25° C. The number of copper spots deposited in the vicinity of the seam was counted by using a microscope. The measurement was conducted on 5 test pieces. When no spot was found in any of the test pieces, the property was evaluated as being good, and when deposition of copper was observed in two or more of the test pieces, the property was evaluated as being bad.

2. Current Value at Constant Voltage Electrolysis

The above-mentioned test piece as completely sealed by a vinyl tape and a wax except the portion covered with the composite film.

The test piece was immersed in an electrolyte consisting of an aqueous solution containing 3% of sodium chloride at 25° C. for 3 minutes and the contact voltage electrolysis was carried out under a voltage of 10.0 V for 10 seconds by using a carbon rod as the counter electrode, and the average flowing electric current was measured. The arithmetic mean (mA/side seam) of the measured values of five test pieces was shown.

(Evaluation at Actual Can Test)

A content was filled, and heat sterilization was carried out if necessary. The can was stored at 37° C. for 1 year and was tested according to the following procedures.

1. Amount Generated of Hydrogen

The gas in the can was collected when the can was opened, and the amount of hydrogen was examined by gas chromatography. The arithmetic means of 10 cans was calculated and shown. When the can was swollen during the storage, this was indicated by "swollen can".

2. Perforation and State of Bonded Portion of Inner Face of Can

In connection with a can in which leakage of a content (liquid) was observed, and the corrected portion in the vicinity of the seam was observed by a microscope after opening and and the can in which the presence of piercing holes was designated as "perforated can". The ratio of the perforated cans to the total cans tested was calculated and shown. After opening, the corrected portion in the vicinity of the seam was observed with the naked eye or by a microscope, and the corrosion state was examined. The number of cans subjected to the storage test was 100, and the corrosion state was examined with respect to optionally chosen 50 cans.

3. Amount of Dissolved Iron

The test was conducted only in the case where the content was an apple drink. After opening, all the content was subjected to ashing, and the ash was dissolved again in hydrochloric acid. The supernatant liquid was subjected to atomic absorption spectroscopy and the iron content in the content was determined. The arithmetic mean of 10 cans was calculated and shown.

EXAMPLE 1

The bonded portion of the TFS welded can body was covered with a composite film shown in Table 1, which had a width of 8 mm. For covering, the film on a rubber bar located on the inner side of the can body was pressed to the bonded portion, and in this state, the film was heated at a temperature higher by 50° C. than the softening temperature (158° C.) of the copolyester layer by high-frequency induction heating from the outside and then held and cooled at a temperature close to the solidifying temperature. In run No. 4, the film was temporarily bonded at about 180° C. according to the above-mentioned method, and then, the film was heated and fused in a hot air oven at 275° C. for 10 minutes. The so-obtained seam covered welded can body was subjected to beading and flanging, and a TFS lid for a can having a nominal inner diameter of 65.3 mm, having the inner and outer surfaces coated with an epoxy-phenolic paint, was double-seamed to the can body, and tomato sauce or apple drink (50%) was packed in the obtained one end seam can. Then, a TFS lid as described above was double-seamed. The apple drink was hot-filled at 90° C., while the tomato sauce was filled at room temperature and then subjected to heating sterilization at 116° C. for 90 minutes. The covering characteristics of the composite film were examined. The obtained results are shown in Table 1. From the results shown in Table 1, it is seen that the properties of covering are greatly influenced by the presence or absence of a molecularly oriented crystal in the polyester layer (I) of the composite film.

TABLE 1

| | Film Structure | | Properties of Film | | |
|---|---|---|---|---|---|
| | Film Layer (I) (thickness, μm) | Film Layer (II) (thickness, μm) | Absence or presence of molecularly oriented crystal in layer (I) (density, g/cc) | Elastic modulus (kg/mm²) of composite film, (softening temperature of layer (II)) | Processability, Copper sulfate test, current value (mA/side seam) |
| | Composition: 100 mole % of terephthalic acid, 98 mole % of ethylene glycol, 2 mole % of diethylene glycol | Composition: 35/55/10 blend of polyethylene terephthalate/isophthalate (copolymerization ratio of 80/20), polybutylene terephthalate/isophthalate (copolymerization ratio of 65/35) and ionomer (Surlyn) | | | |
| Run No. 1 | biaxially drawn film (30 μm) (draw ratio of 4 × 4) | melt-extrusion coating (40 μm) | presence (1.404) | 65 (158° C.) | good (0) |
| Run No. 2 | monoaxially drawn film (20 μm) (draw ratio of 3) | melt-extrusion coating (40 μm) | presence (1.384) | 42 (158° C.) | good (0) |
| Run No. 3 | undrawn film (30 μm) | melt-extrusion coating (40 μm) | absence (1.336) | 15 (158° C.) | bad (1.5) |
| Run No. 4 | biaxially drawn film (30 μm) (draw ratio of 2 × 2) | melt-extrusion coating (40 μm) | absence (1.376) | 75 (158° C.) | bad (7.3) |

| | Actual Can Test | | | | | |
|---|---|---|---|---|---|---|
| | tomato sauce | | | apple drink (50%) | | |
| | amount generated (ml/can) | state | number of perforated | amount (ppm) of dissolved | state of | number of perforated |

TABLE 1-continued

| | of $H_2$ | of seam | cans | can | seam | cans |
|---|---|---|---|---|---|---|
| Run No. 1 | 0.08 | not changed | 0 | 3.3 | not changed | 0 |
| Run No. 2 | 0.11 | not changed | 0 | 2.9 | not changed | 0 |
| Run No. 3 | 3.11 | partial spot corrosion | 2 | 8.3 | partial spot corrosion | 0 |
| Run No. 4 | swollen can | spot corrosion on substantially entire surface | 22 | 16.2 | spot corrosion | 0 |

EXAMPLE 2

A tinplate welded can body was covered with a composite film shown in FIG. 2, which had a width of 8 mm, in the same manner as described in Example 1. The heating temperature adopted for the covering operation was a temperature higher by 60° C. than the softening temperature of the copolyester layer (II). The obtained seam covered welded can body was subjected to flanging, and a tinplate lid for a can having a nominal inner diameter of 65.3 mm, having the inner and outer surfaces coated with the same epoxy-phenolic paint as the inner face of the can body, was double-seamed to the can body. The can was packed with salmon or tomato sauce, and a tinplate lid as described above was double-seamed. The can was subjected to heating sterilization at 116° C. for 90 minutes, stored under predetermined conditions and evaluated. The covering properties of the composite film were examined. The obtained results are shown in Table 2. From the results shown in Table 2, it is seen that the covering properties are greatly influenced by the composition of the polyester layer (I) of the composite film.

TABLE 2

| | Construction of Film | | Properties of Film | | |
|---|---|---|---|---|---|
| | Layer (I) (composition, mole %) (thickness, μm) biaxially drawn film (25 μm) (draw ratio of 3 × 3) | Layer (II) (thickness, μm) (melt-extrusion) | layer (I) presence or absence of molecularly oriented crystal (density) | elastic modulus ($kg/mm^2$) of composite film (softening temperature of layer (II)) | Processability, copper sulfate test, current value (mA/side seam) |
| Run No. 5 | terephthalic acid 95, isophthalic acid 5, ethylene glycol 100 | composition (mole %): quaternary copolymer of terephthalic acid (80), sebacic acid (20), ethylene glycol (20) and 1,4-butane diol (80) (35 μm) | presence (1.393) | 57 (153° C.) | good (0) |
| Run No. 6 | terephthalic acid 90, isophthalic acid 10, ethylene glycol 90, diethylene glycol 10 | | presence (1.387) | 52 (153° C.) | good (0) |
| Run No. 7 | terephthalic acid 80, isophthalic acid 20, ethylene glycol 100 | | presence (1.358) | 32 (153° C.) | good (0) |
| Run No. 8 | terephthalic acid 80, isophthalic acid 20, ethylene glycol 100 | composition: 60/40 blend of polyethylene terephthalate/adipate (85/15 copolymerization ratio) and polybutylene terephthalate/isophthalate (65/35 copolymerization ratio (35 μm) | presence (1.372) | 7 (182° C.) | good (0) |
| Run No. 9 | terephthalic acid 100, ethylene glycol 85, diethy- | | presence (1.375) | 21 (182° C.) | good (0.2) |
| Run No. 10 | terephthalic acid acid 85, tetrahydrophthalic acid 15, ethylene glycol 85, propylene glycol 15 | | presence (1.329) | 18 (182° C.) | bad (2.5) |

| | Actual Can Test | | | | | |
|---|---|---|---|---|---|---|
| | salmon | | | tomato sauce | | |
| | amount generated (ml/can) of $H_2$ | state of seam | number of perforated cans | amount generated (ml/can) of $H_2$ | state of seam | number of perforated cans |
| Run No. 5 | 0.15 | not changed | 0 | 0.15 | not changed | 0 |
| Run No. 6 | 0.19 | not changed | 0 0 | 0.21 | practically usable inspite of partial whitening of gas phase portion | 0 |
| Run No. 7 | 0.37 | blackening on substantially entire surface | 0 | 1.15 | partial spot corrosion | 0 |

TABLE 2-continued

| | | | | | | |
|---|---|---|---|---|---|---|
| Run No. 8 | 0.34 | blackening on substantially entire surface | 0 | 2.15 | partial spot corrosion | 4 |
| Run No. 9 | 0.25 | partial blackening | 0 | 1.86 | partial spot corrosion | 2 |
| Run No. 10 | 0.26 | partial blackening | 0 | swollen can | spot corrosion on entire surface | 12 |

EXAMPLE 3

The welded-bonded portion of the same TFS welded can body as used in Example 1 was covered with a composition shown in Table 3, which had a width of 8 mm, in the same manner as described in Example 1 except that the heating temperature was a temperature higher by 50° C. than the softening temperature of the copolyester layer (II). The so-obtained seam covered welded can body was subjected to beading and flanging, and a TFS lid for a can having a nominal inner diameter of 65.3 mm having the inner and outer surface coated with an epoxy-phenolic paint, was double-seamed to the can body. The obtained one end seam can was packed with tomato sauce or apple drink (50%) and a TFS lid as described above was double-seamed. Incidentally, the apple drink was hot-filled at 90° C., while the tomato sauce was filled at room temperature and heat-sterilized at 116° C. for 90 minutes. The covering properties of the composite film were evaluated. The obtained results are shown in Table 3. From the results shown in Table 3, it is seen that the covering properties are greatly influenced by the resin composition of the copolyester layer (II) of the composite film.

TABLE 3

| | Construction of Film | | Properties of Film | |
|---|---|---|---|---|
| | | layer (II) (composition, mole %) (thickness of 30 μm) (all by melt extrusion coating) | layer (I), presence or absence of molecularly oriented crystal (density) | composite film, elastic modulus (kg/mm$^2$) (softening temperature of layer (II)) |
| | layer (I) (thickness of 38 μm) composition (mole %) | | | |
| Run No. 11 | terephthalic acid 100, ethylene glycol 100 | polyethylene terephthalate/isophthalate (copolymerization ratio 75/25) | presence (1.385) | 37 (185° C.) |
| Run No. 12 | biaxially drawn film (draw ratio of 3 × 3) | 80/20 blend of polyethylene terephthalate/isophthalate (copolymerization ratio of 75/25) and polybutylene terephthalate (copolymerization ratio of 65/35) | presence (1.388) | 42 (184° C.) |
| Run No. 13 | ↓ | 80/20 blend of polyethylene terephthalate/isophthalate (copolymerization ratio of 75/25) and polybutylene terephthalate (copolymerization ratio of 65/35) blend ratio of 30/70 | presence (1.396) | 72 (158° C.) |
| Run No. 14 | ↓ | 80/20 blend of polyethylene terephthalate/isophthalate (copolymerization ratio of 75/25) and polybutylene terephthalate (copolymerization ratio of 65/35) blend ratio of 5/95 | presence (1.396) | 80 (153° C.) |
| Run No. 15 | ↓ | polybutylene terephthalate/isophthalate (copolymerization ratio of 65/35) | presence (1.398) | 81 (153° C.) |
| Run No. 16 | ↓ | copolymer of terephthalic acid 40, isophthalic acid 60, ethylene glycol 60 and 1,4-butane diol 40 | presence (1.400) | 104 (135° C.) |
| Run No. 17 | ↓ | copolymer of terephthalic acid 30, isophthalic acid 30, adipic acid 40, ethylene glycol 60 and 1,4-butane diol 40 | presence (1.400) | 96 (154° C.) |
| | layer (I) | | | |
| Run No. 18 | biaxially drawn film (draw ratio of 3 × 3) | copolymer of terephthalic acid 40, isophthalic acid 40, sebacic acid 20, ethylene glycol 60 and 1,4-butane diol 40 | presence (1.397) | 83 (156° C.) |
| Run No. 19 | ↓ | copolymer of terephthalic acid 60, isophthalic acid 35, sebacic acid 5, ethylene glycol 35 and 1,4-butane diol 65 | presence (1.392) | 60 (167° C.) |
| Run No. 20 | ↓ | copolymer of terephthalic acid | presence (1.386) | 48 |

TABLE 3-continued

| | | | | |
|---|---|---|---|---|
| | | 95, sebacic acid 5, ethylene glycol 30, 1,4-butane diol 65 and triethylene glycol 5 | | (183° C.) |
| Run No. 21 | ↓ | copolymer of terephthalic acid 100, ethylene glycol 20, 1,4-butane diol 60 and neopentyl glycol 20 | presence (1.372) | 40 (192° C.) |
| Run No. 22 | ↓ | copolymer of terephthalic acid 70, isophthalic acid 30, ethylene glycol 70 and neopentyl glycol 30 | presence (1.402) | 110 (132° C.) |

| | Processability, copper sulfate test, current value (mA/side seam) | Actual Can Test | | | | | |
|---|---|---|---|---|---|---|---|
| | | tomato sauce | | | apple drink (50%) | | |
| | | | state of seam | number of perforated cans | | state of seam | number of perforated cans |
| | | amount (ml/can) of generated $H_2$ | | | amount (ppm) of dissolved can | | |
| Run No. 11 | bad (12.5), adhesion failure between inner face coating and layer (II) | swollen can | spot corrosion on substantially entire surface | 39 | 13.2 | spot corrosion | 0 |
| Run No. 12 | good (0) | 0.85 | slight spot corrosion | 0 | 6.5 | not changed | 0 |
| Run No. 13 | good (0) | 0.35 | not changed | 0 | 5.3 | not changed | 0 |
| Run No. 14 | good (0) | 0.67 | not changed | 0 | 5.9 | not changed | 0 |
| Run No. 15 | bad (0.2), delamination between layers (I) and (II) | 1.98 | violent spot corrosion | 1 | 10.2 | partial spot corrosion | 0 |
| Run No. 16 | good (0) | swollen can | spot corrosion on substantially entire surface | 8 | 7.2 | partial spot corrosion | 0 |
| Run No. 17 | good (0) | 2.31 | violent spot corrosion | 3 | 6.7 | slight spot corrosion | 0 |
| | | amount (ml/can) of perforated $H_2$ | | | amount (ppm) of dissolved iron | | |
| Run No. 18 | good (0) | 0.21 | not changed | 0 | 4.8 | not changed | 0 |
| Run No. 19 | good (0) | 0.23 | not changed | 0 | 5.0 | not changed | 0 |
| Run No. 20 | good (0) | 0.31 | not changed | 0 | 6.4 | not changed | 0 |
| Run No. 21 | good (0), cracking in layer (II) | 3.43 | spot corrosion, partial blister | 5 | 9.7 | slight spot corrosion | 0 |
| Run No. 22 | good (1.3), adhesion failure between inner coating and layer (II) | swollen can | spot corrosion on substantially entire surface | 27 | 15.2 | spot corrosion | 0 |

EXAMPLE 4

The welded-bonded portion of the welded can body of the thinly nickel-plated steel plate was covered with a composite film shown in Table 4, which had a width of 8 mm, in the same manner as described in Example 1. Composite films used were prepared in the following manner according to the thickness of each layer. More specifically, in each of runs Nos. 23 through 25, a biaxially drawn (draw ratio of 3×3) polyester film (layer (I)) was heat-laminated with a separately prepared copolyester film (layer (II)). In each of runs Nos. 25 through 27, a copolyester having a shown thickness was melt-extrusion-coated on the above-mentioned layer (I) in the same manner as adopted in the preceding examples. In each of runs No. 28 and 29, a two-layer film of a polyester and a copolyester, obtained by co-extrusion, was biaxially drawn (draw ratio of 3×3) and thermally set. The heating temperature adopted for the covering operation was a temperature higher by 50° C. than the softening temperature of the copolyester layer (II). The obtained seam covered welded can body was subjected to necked-in processing, beading and flanging, and a lid of a thinly nickel-plated steel plate for a can having a nominal inner diameter of 62.6 mm, having the inner and outer surfaces coated with an epoxy-phenolic paint, was double-seamed to the can body. The obtained one end seam can was packed with tuna dressing or apple drink (50%) and a lid as described above was double-seamed. The apple drink was hot-filled at 90° C. while the tuna dressing was heat-sterilized at 116° C. for 90 minutes after filling. The covering properties of the composite film were evaluated. The obtained results are shown in Table 4. From the results shown in Table 4, it is seen that the covering properties are greatly influenced by the elastic modulus of the composite film at a temperature lower by 20° C. than the softening temperature of the copolyester layer (II) corresponding to the adhesive layer of the composite film.

TABLE 4

| | Construction of Film | | Properties of Film | | |
|---|---|---|---|---|---|
| | layer (I) | layer (II) | layer (I), presence or absence of molecularly oriented crystal (density) | composite film, elastic modulus ($kg/mm^2$) (softening temperature of layer (II)) | Processability, copper sulfate test, current value (mA/side seam) |
| | Composition (mole %): terephthalic acid 100, ethylene glycol 97, diethylene glycol 3 | Composition: 20/60/20 blend of polyethylene terephthalate/isophthalate (copolymerization ratio of 80/20), polybutylene terephthalate/isophthalate (copolymerization ratio of 60/40) and ionomer (Surlyn) | | | |
| Run No. 23 | biaxially drawn film thickness of 2 μm | thickness of 85 μm | presence (1.385) | 4 (148° C.) | good (0) |
| Run No. 24 | thickness of 7 μm | thickness of 100 μm | presence (1.390) | 17 (148° C.) | good (0) |
| Run No. 25 | thickness of 12 μm | thickness of 50 μm | presence (1.394) | 48 (148° C.) | good (0) |
| Run No. 26 | thickness of 16 μm | thickness of 30 μm | presence (1.399) | 85 (148° C.) | good (0) |
| Run No. 27 | thickness of 65 μm | thickness of 30 μm | presence (1.395) | 170 (148° C.) | good (0) |
| Run No. 28 | thickness of 38 μm | thickness of 5 μm | presence (1.405) | 215 (148° C.) | good (0.1) |
| Run No. 29 | thickness of 65 μm | thickness of 2 μm | presence (1.393) | 240 (148° C.) | bad (1.1), cracking in seamed portion |

| | Actual Can Test | | | | | |
|---|---|---|---|---|---|---|
| | tuna dressing | | | apple drink (50%) | | |
| | amount (ml/can) of generated $H_2$ | state of seam | number of perforated cans | amount (ppm) of dissolved iron | state of seam | number of perforated cans |
| Run No. 23 | 3.41 | spot corrosion on substantially entire surface | 4 | 5.3 | partial spot corrosion | 0 |
| Run No. 24 | 0.17 | not changed | 0 | 3.6 | not changed | 0 |
| Run No. 25 | 0.10 | not changed | 0 | 3.3 | not changed | 0 |
| Run No. 26 | 0.06 | not changed | 0 | 2.5 | not changed | 0 |
| Run No. 27 | 0.04 | not changed | 0 | 1.9 | not changed | 0 |
| Run No. 28 | 0.23 | spot corrosion in vicinity of welded portion | 0 | 3.8 | partial spot corrosion | 0 |
| Run No. 29 | many swollen cans | streak corrosion along stepped portion formed by welding | 18 | 14.2 | streak corrosion along stepped portion formed by welding | 0 |

EXAMPLE 5

The welded-bonded portion of the welded can body of the tinplate sheet was covered with a composite film shown in Table 5, which had a width of 8 mm, in the same manner as described in Example 1. The heating temperature adopted for the covering operation was a temperature higher than by 50° C. than the softening temperature of the copolyester layer (II). The so-obtained seam covered welded can body was subjected to flanging, and a tinplate lid for a can having a nominal diameter of 65.3 mm, having the inner and outer surfaces coated with the same epoxy-phenolic paint as coated on the inner face of the can body, was double-seamed to the can body. The obtained one end seam can was packed with tomato sauce or salmon, and a tinplate lid as described above was double-seamed. The packed can was heat-sterilized at 116° C. for 90 minutes, stored under predetermined conditions and then evaluated. The covering properties of the composite film were examined. The obtained results are shown in Table 5. From the results shown in Table 5, it is seen that the covering properties are influenced by the dispersion structure of the ionomer contained in the copolyester layer. Furthermore, when the results shown in Table 5 are compared with the results shown in Table 2, it is seen that improving effects can be attained by dispersing the ionomer in the copolyester layer.

TABLE 5

| | Properties of Film |
|---|---|
| | composite film, |

TABLE 5-continued

| | Construction of Film: layer (I), (thickness of 50 μm) | Construction of Film: layer (II), (thickness of 30 μm) | dispersion state | layer (I), presence or absence of molecularly oriented crystal (density) | elastic modulus (kg/mm²) (softening temperature of layer (II)) |
|---|---|---|---|---|---|
| | Composition (mole %): terephthalic acid 98, isophthalic acid 2, ethylene glycol 100, biaxially drawn (draw ratio of 4 × 4) film containing 2.5% of titanium white, $TiO_2$ | Composition: blend of copolymer of terephthalic acid 90, sebacic acid 10, ethylene glycol 30 and 1,4-butane diol 70 and ionomer (Surlyn) (melt-extrusion coating) | | | |
| Run No. 30 | ↓ | blend ratio = 95:5 | sea/island structure of copolyester/Surlyn | presence (1.405) | 70 (173° C.) |
| Run No. 31 | ↓ | blend ratio = 85:15 | sea/island structure of copolyester/Surlyn | presence (1.406) | 68 (170° C.) |
| Run No. 32 | ↓ | blend ratio = 70:30 | sea/island structure of copolyester/Surlyn (partially disturbed) | presence (1.408) | 65 (168° C.) |
| Run No. 33 | ↓ | blend ratio = 60:40 | partial sea/island structure of copolyester/Surlyn | presence (1.410) | 59 (152° C.) |
| Run No. 34 | ↓ | blend ratio = 50:50 | disturbed laminar structure of copolyester and Surlyn | presence (1.413) | 56 (129° C.) |

| | | Actual Can Test: Salmon | | | Actual Can Test: tomato sauce | | |
|---|---|---|---|---|---|---|---|
| | Processability, copper sulfate test, current value (mA/side seam) | amount (ml/can) of generated $H_2$ | state of seam | number of perforated cans | amount (ml/can) of generated $H_2$ | state of seam | number of perforated cans |
| Run No. 30 | good (0) | 0.20 | slight blackening | 0 | 0.10 | not changed | 0 |
| Run No. 31 | good (0) | 0.10 | not changed | 0 | 0.07 | not changed | 0 |
| Run No. 32 | good (0) | 0.08 | not changed | 0 | 0.06 | not changed | 0 |
| Run No. 33 | good (0) | 0.09 | not changed | 0 | 0.16 | partial whitening in gas phase portion | 0 |
| Run No. 34 | good (0.8) partial adhesion failure from inner face coating | 0.43 | not changed | 0 | 3.05 | vigorous spot corrosion | 6 |

EXAMPLE 6

A 35/55/10 blend of polyethylene terephthalate/isophthalate (copolymerization ratio of 80/20), polybutylene terephthalate/isophthalate (copolymerization ratio of 65/35) and an ethylene/vinyl acetate copolymer was melt-extrusion-coated in a thickness of 30 μm on a biaxially drawn polyethylene terephthalate film (composition: terephthalic acid=100 mole%, ethylene glycol=at least 98 mole%) having a thickness of 9μ and being coated with a polyvinylidene chloride resin (having a vinylidene chloride content of 75 mole%) in a thickness of 5 μm, and by using the so-obtained composite film, the welded-bonded portion of the TFS welded can body was covered in the same manner as described in Example 1. The heating temperature adopted for the covering operation was a temperature higher by 50° C. than the softening temperature (156° C.) of the copolyester layer (II). The so-obtained seam covered can body was subjected to beading and flanging and a TFS lid for a can having a nominal inner diameter of 65.3 mm, having the inner and outer surfaces coated with an epoxy-phenolic paint, was double-seamed to the can body. The obtained one end seam can was packed with tomato sauce or apple drink (50%), and a TFS lid as described above was double-seamed. The filling and sterilizing conditions were the same as described in Example 1.

The properties of the composite film for covering the seam of the welded can were found to be substantially the same as those obtained in Example 1, though the total film thickness was smaller and the ethylene/vinyl acetate copolymer was used instead of the ionomer in the resin composition of the layer (II).

We claim:

1. A welded can with at least the inner surface of the weld seam having a composite film covering comprising a first layer (II) contacting the seam of a thermoplastic copolyester comprising a dibasic acid component composed of 40 to 95 mole % of terephthalic acid and 5 to 60 mole % of a dibasic acid other than terephthalic acid, with the proviso that isophthalic acid is present in an amount of 0 to 40 mole % based on the dibasic acid component, and a diol component composed of 65 to 100 mole % of ethylene glycol and butane diol and 0 to 35 mole % of a diol other than ethylene glycol and butane diol, said ethylene glycol and butane diol being present at molar ratio of from 5/95 to 80/20, or a blend of such copolyesters, and an overlying second layer (I) which is the innermost layer on the can, comprising a thermoplastic polyester having a molecularly oriented crystal and comprising a dibasic acid component composed of 90 to 100 mole % of terephthalic acid and 0 to 10 mole % of a dibasic acid other than terephthalic acid and a diol component composed of 90 to 100 mole % of ethylene glycol and 0 to 10 mole % of a diol other than ethylene glycol, said composite film covering having an elasticity modulus of 5 to 220 kg/mm$^2$ at a temperature lower by than 20° C. than the softening temperature of the resin of the first layer (II).

2. A welded can as set forth in claim 1, wherein the layer (I) of the thermoplastic polyester having the molecularly oriented crystal and the thermoplastic copolyester or copolyester blend layer (II) are applied in the form of a laminate film to the weld seam on the inner face side of the can and heat-bonded in the state where the molecularly oriented crystal is maintained in the polyester layer (I).

3. The welded can of claim 1 wherein the composite film has an elasticity modulus of 15 to 200 kg/mm$^2$, at a temperature lower by 20° C. than the softening point of the resin of the first layer (II).

4. The welded can of claim 1 wherein the molecularly oriented crystalline thermoplastic polyester comprising the innermost layer of the can is comprised of polyethylene terephthalate.

5. The welded can of claim 1 wherein the thermoplastic copolyester of the first layer (II) contacting the seam comprises a dibasic acid component comprising 60 to 90 mole % of terephthalic acid and 10 to 40 mole % of a dibasic acid other than terephthalic acid, with the proviso that isophthalic acid is present in an amount of 0 to 35 mole % based on the dibasic acid component, and a diol component composed of 65 to 100 mole % of ethylene glycol and butane diol and 0 to 45 mole % of a diol other than ethylene glycol and butane diol, said ethylene glycol and butane diol being present at a molar ratio of from 10/90 to 75/25.

6. The welded can of claim 1 wherein the composite film covering has a thickness of from 10 to 150 microns.

7. The welded can of claim 6 wherein the seam contacting first layer (II) has a thickness of from 5 to 120 microns and the overlying second layer (I) has a thickness of from 2 to 120 microns.

8. The welded can of claim 1 wherein the composite film has a thickness of from 15 to 100 microns.

9. The welded can of claim 8 wherein the seam contacting first layer (II) has a thickness of from 10 to 100 microns and the overlying second layer (I) has a thickness of from 7 to 90 microns.

10. The welded can of claim 1 wherein the thermoplastic copolyester of the seam contacting first layer (II) comprises a blend of polyethylene terephthalate/isophthalate and polybutylene terephthalate/isophthalate.

11. The welded can of claim 1 wherein the thermoplastic copolyester of the seam contacting first layer (II) comprises a blend of polyethylene terephthalate/isophthalate and polybutylene terephthalate.

12. The welded can of claim 1 wherein the thermoplastic copolyester of the seam contacting first layer (II) comprises a copolymer of terephthalic acid, isophthalic acid, sebacic acid, ethylene glycol and 1,4-butane diol.

13. The welded can of claim 1 wherein the thermoplastic copolyester of the seam contacting first layer (II) comprises a copolymer of terephthalic acid, sebacic acid, ethylene glycol, 1,4-butane diol and triethylene glycol.

14. A welded can as set forth in claim 1, wherein the layer (II) contains an acid-modified olefin resin in an amount of 3 to 40% by weight based on the thermoplastic copolyester or copolyester blend, wherein the copolyester or blend is present as a continuous phase and the acid-modified olefin resin is present as a dispersed phase of particles.

15. The welded can of claim 2 wherein the acid-modified olefin resin is present in an amount of 10 to 30% by weight, based on the copolyester of copolyester blend.

16. The welded can of claim 2 wherein the dibasic acid other than terephthalic acid is phthalic acid, adipic acid, or sebacic acid, and the diol component, other than ethylene glycol and butane diol is diethylene glycol, triethylene glycol, propylene glycol, neopentyl glycol or xylylene glycol.

17. The welded can of claim 2 wherein the acid-modified olefin resin is an ethylene/acrylic acid copolymer, maleic anhydride-grafted polyethylene, maleic anhydride-grafted polypropylene or an ion-crosslinked olefin copolymer.

* * * * *